US012571263B2

(12) United States Patent
Zur Linde et al.

(10) Patent No.: US 12,571,263 B2
(45) Date of Patent: Mar. 10, 2026

(54) EXPANDING DRILL DEVICE

(71) Applicant: HERRENKNECHT AG, Schwanau (DE)

(72) Inventors: Lutz Zur Linde, Lahr (DE); Tobias Engel, Gundelfingen (DE)

(73) Assignee: Herrenknecht, Schwanau (DE)

( * ) Notice: Subject to any disclaimer, the term of this patent is extended or adjusted under 35 U.S.C. 154(b) by 0 days.

(21) Appl. No.: 18/696,202

(22) PCT Filed: Oct. 3, 2022

(86) PCT No.: PCT/EP2022/077488
§ 371 (c)(1),
(2) Date: Mar. 27, 2024

(87) PCT Pub. No.: WO2023/057400
PCT Pub. Date: Apr. 13, 2023

(65) Prior Publication Data

US 2025/0188805 A1 Jun. 12, 2025

(30) Foreign Application Priority Data

Oct. 6, 2021 (DE) ..... 10 2021 125 909.6

(51) Int. Cl.

| | |
|---|---|
| ***E21B 10/26*** | (2006.01) |
| ***E21B 7/28*** | (2006.01) |
| ***E21B 21/00*** | (2006.01) |
| *E21B 7/04* | (2006.01) |
| *E21B 47/00* | (2012.01) |
| *F04F 5/54* | (2006.01) |

(52) U.S. Cl.
CPC ..... *E21B 10/26* (2013.01); *E21B 7/28* (2013.01); *E21B 21/00* (2013.01); *E21B 7/046* (2013.01); *E21B 47/00* (2013.01); *F04F 5/54* (2013.01)

(58) Field of Classification Search
CPC . E21B 7/28; E21B 10/26; E21B 21/00; E21B 47/00; E21B 7/046
See application file for complete search history.

(56) References Cited

U.S. PATENT DOCUMENTS 2,874,936 A * 2/1959 Gonzales ..... E21B 7/046 405/184

FOREIGN PATENT DOCUMENTS

| | | | |
|---|---|---|---|
| DE | 2701066 | A1 * | 9/1977 |
| DE | 3620026 | A1 | 9/1987 |
| DE | 202009018579 | U1 | 2/2012 |

(Continued)

*Primary Examiner* — Caroline N Butcher
(74) *Attorney, Agent, or Firm* — Mark Rodgers

(57) ABSTRACT

The disclosure describes an expanding drill device for expanding a pilot bore by moving the expanding drill device along a specified drilling line comprising: a housing; a drill head that has a cutting wheel which is arranged on the drill side of the expanding drill device so as to be rotatably mounted and driven about a rotational axis and relative to the housing and on which at least one drill tool for loosening the ground or the rock is arranged; and a drill-side connection for producing a connection to a pipe section located in the pilot bore on the drill side, wherein the drill side centrally has at least one receiving chamber for the loosened ground or the loosened rock, said receiving chamber being connected to a material conveyor device of the expanding drill device.

15 Claims, 6 Drawing Sheets

(56) References Cited

FOREIGN PATENT DOCUMENTS

Figure 1:
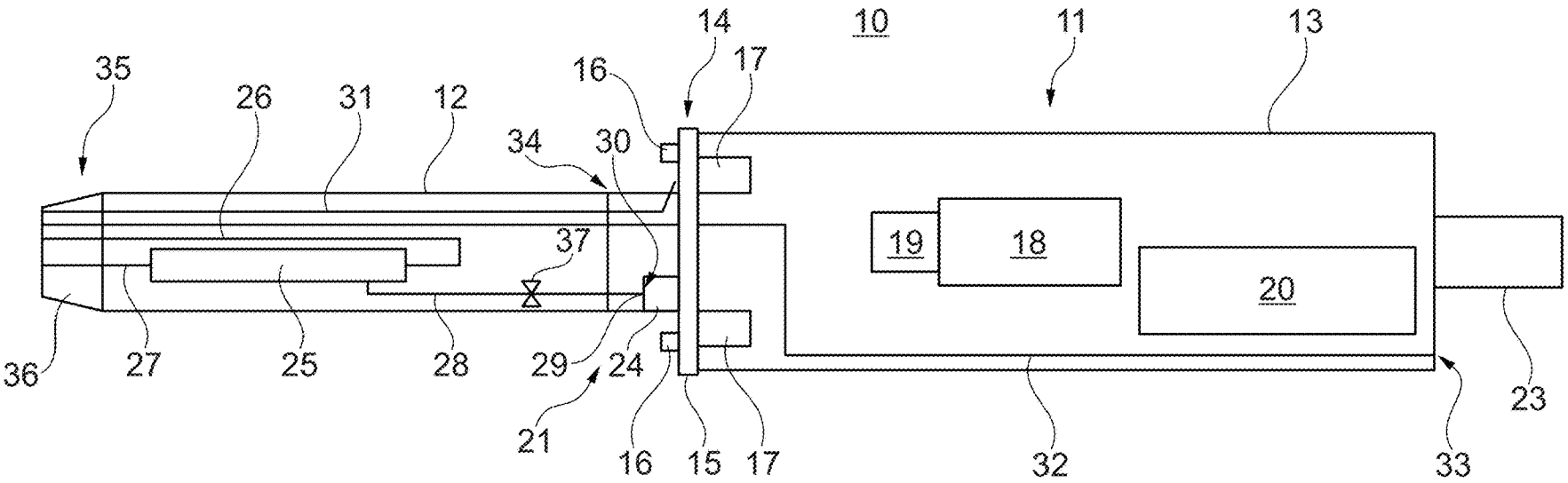

| | | | |
|---|---|---|---|
| DE | 102012004762 | A1 | 9/2013 |
| DE | 102013000771 | A1 | 7/2014 |
| EP | 0360321 | A1 | 3/1990 |

* cited by examiner

EXPANDING DRILL DEVICE

The invention relates to an expanding drill device for expanding a pilot bore created from a starting point to a target point in the ground along a specified drilling line, preferably near the surface, by moving the expanding drill device along the specified drilling line in order to create a bore in the ground or in rock for introducing a pipeline or a supporting system into the expanded bore, comprising: a housing; a drill side and a rear side opposite the drill side; a drill head that has a cutting wheel, which is arranged on the drill side of the expanding drill device so as to be mounted and driven rotatably about a rotational axis and relative to the housing and on which at least one drill tool for loosening the ground or the rock is arranged; a drill-side connection for producing a connection to a pipe section, preferably a pilot drill section, located in the pilot bore on the drill side; a rear-side connection for the pipeline to be introduced on the rear side of the drill head, wherein the drill side is provided centrally with at least one receiving chamber for the loosened ground or the loosened rock, said receiving chamber being connected via at least one removal opening to a material conveying device of the expanding drill device for the loosened ground or the loosened rock, wherein the drill side centrally has at least one receiving chamber for the loosened ground or the loosened rock, said receiving chamber being connected via at least one removal opening to a material-conveying device of the expanding drill device for the loosened ground or the loosened rock, wherein the drill side has at least one drill chamber in which the cutting wheel is arranged, which is arranged around the receiving chamber, wherein the cutting wheel is annular and is arranged rotatably about the central receiving chamber, and wherein the receiving chamber is connected via at least one conveying opening to the drill chamber so that the loosened ground or the loosened rock can be conveyed through the opening into the receiving chamber.

When underground cables are laid near the surface, the open trench design is used. This sometimes leads to considerable environmental intrusion along the route and is associated with an amount of effort that should not be underestimated for excavating and refilling the trench.

With trenchless laying, long distances must be achieved between manholes to minimize intrusion into nature during the construction phase and building costs. In this case, the aim is to achieve distances between manholes of up to 1500 m. A problem when laying near the surface is the small depth of coverage of the line (for example only 2 to 6 m).

This is a problem in particular when it is not possible for structural reasons, for example owing to the conditions on site, to drill the bore and to introduce a pipeline into the bore immediately afterwards. In this case, it may be necessary to expand the bore.

With respect to the requirements for the diameter and the section length, such laying would be conceivable using the Horizontal Directional Drilling (HDD) method. In this method, a pilot bore is first created from the starting point toward a target point, using a rotating drill head and drill pipe. The positional accuracy is ensured by means of a measurement system, which is attached behind the drill head. The excavated material is conveyed above ground using a bentonite suspension. The bentonite suspension is pumped through the drill pipe directly to the nozzles attached to the drill head. The suspension is mixed with the loosened ground and flows back to the starting point through the annular space between the drill pipe and the ground. After the pilot bore is finished, the drill head is replaced by an expanding drill head, also referred to as a reamer, which then expands the pilot bore while the pipeline is also drawn in. Such a method is known from EP0360321A1.

In the HDD method, however, high fluid pressures are necessary for clean discharge of the loosened ground. In this case, however, the largest possible laying depths and thus depths of coverage of for example more than 30 m are necessary in the HDD method to prevent undesirable exit of fluid at the surface. With certain ground conditions, laying depths in the range of less than 10 m can lead to undesirable exit of fluid in the conventional HDD method.

A previously described drill head is known from DE2701066A1. This is used to expand a pilot bore while advancing the pipe. DE2701066A1 discloses a method and a device for laying pipes underground. A discharge head is used, with which a pilot bore is expanded and to which the pipeline to be introduced is attached. A conveying screw of a screw conveyor is provided in the pilot pipe section and conveys away the ground loosened by the blades of the rotating discharge head. The loosened ground passes through openings into the conveying chamber of the screw conveyor. The disclosed method and the disclosed device cannot be used in particular to implement the necessary laying lengths near the surface, especially with relatively small pipeline diameters. Furthermore, the ground, which may be very mixed in the region near the surface, also cannot be excavated and conveyed away reliably using the disclosed method and the disclosed device.

The object of the invention is to provide an expanding drill device with which it is also possible to expand a pilot bore near the surface even in very heterogeneous ground.

This object is achieved in that at least one crusher is provided in the drill chamber, and that the crusher has crusher bars on the rotatable cutting wheel, which move together with the cutting wheel, and crusher bars on a side of the receiving chamber facing the drill chamber, which are fixedly arranged together with the receiving chamber, and that the crusher bars are arranged relative to one another such that a crushing gap exists between the crusher bars.

It is advantageous here that the expanding drill device can be used near the surface and can expand a pilot bore near the surface and at the same time introduce a pipeline, for example a pipeline for creating a pipeline system or a district heating line or else a protective pipe for laying electrical cables or the like, into the expanded borehole. The central receiving chamber allows simple removal through the pipe section located in the pilot bore, so that the risk of blowouts as in the HDD method is minimized. The provision of the crusher ensures that the loosened ground or the loosened rock is in the form of conveyable grain sizes. Furthermore, this simple construction of the crusher has proven surprisingly effective.

A further teaching of the invention provides for the receiving chamber to be a hollow cylinder, the end faces of which are closed. It is also advantageous that the receiving chamber is a suction box. It is also advantageous that the at least one removal opening of the receiving chamber is arranged on an end face of the hollow cylinder. Preferably, a suction box is provided at the removal opening. The loosened ground/rock can thereby be reliably transported away in a simple manner. Furthermore, it has surprisingly been found that the receiving chamber can be made particularly small and stable thanks to the provision of the receiving chamber as a central hollow cylinder. Furthermore, suction out of the hollow cylinder is efficiently possible.

It is also advantageous here that the at least one conveying opening is arranged d on the outer lateral surface of the hollow cylinder, preferably at the top. The loosened ground or the loosened rock can thereby be introduced into the receiving chamber in a particularly simple and efficient manner. Suction into the receiving chamber through the receiving opening is possible for support. It is advantageous that carriers are provided on the cutting wheel, which move the loosened ground or the loosened rock toward the conveying opening.

A further teaching of the invention provides for the receiving chamber to be connected fixedly to the housing. The necessary forces for expanding and drawing in can thereby be transmitted in a simple manner.

A further teaching of the invention provides for the drill-side connection to be connected fixedly to the housing or to the receiving chamber. The necessary forces for expanding and drawing in can thereby be transmitted in a simple manner.

A further teaching of the invention provides for the at least one conveying opening to be a screening element or for a screening element to be arranged in the at least one conveying opening. This ensures in a simple manner that the loosened ground or the loosened rock passes into the receiving chamber only in conveyable grain sizes.

A further teaching of the invention provides for the material-conveying device of the expanding drill device to have at least one conveying pump, the suction side of which is connected to the removal opening. The loosened ground or the loosened rock can thereby be conveyed away through the pilot drill section in a simple manner. It is advantageous here that the at least one conveying pump is a jet pump. A jet pump allows efficient suction out of the removal chamber in a simple manner. Furthermore, the jet pump makes it possible to convey the loosened ground/rock away over lengths of 2000 m and more with small borehole diameters without additional pumps in the pipe section.

A further teaching of the invention provides for the rear-side connection for one pipeline which is to be introduced into the expanded bore to be connected fixedly to the housing or to the receiving chamber.

It is advantageous here that the rear-side connection has a rotatable portion, which allows a relative rotation between the housing of the expanding drill device and the pipeline to be introduced, preferably a hydraulic cylinder.

It is also advantageous here that the rear-side connection has a measuring element for measuring the drawing-in force acting on the pipeline to be introduced, preferably a hydraulic cylinder.

A further teaching of the invention provides for the housing to have at least one first portion, which has a first diameter that is smaller than an inner diameter of the annular cutting wheel and preferably corresponds substantially to the outer diameter of the pipe section located in the pilot borehole, and a second portion, which is substantially somewhat smaller than the inner diameter of the expanded borehole. A separation of the arrangement of the necessary technology for the removal and the necessary technology for the drilling can thereby be achieved in a simple manner.

A further teaching of the invention provides for at least one discharge opening for discharging a bentonite suspension into the annular space of the expanded bore to be provided on the rear side.

Figure 2:
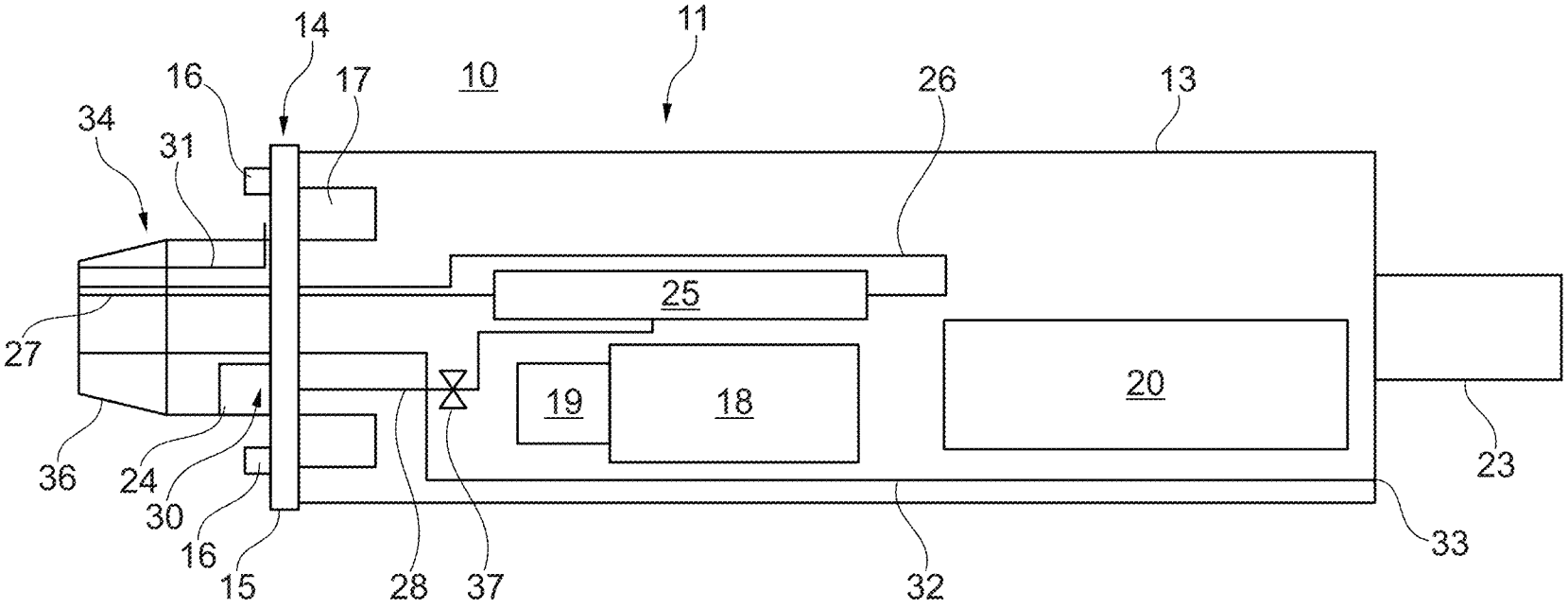
Figure 3:
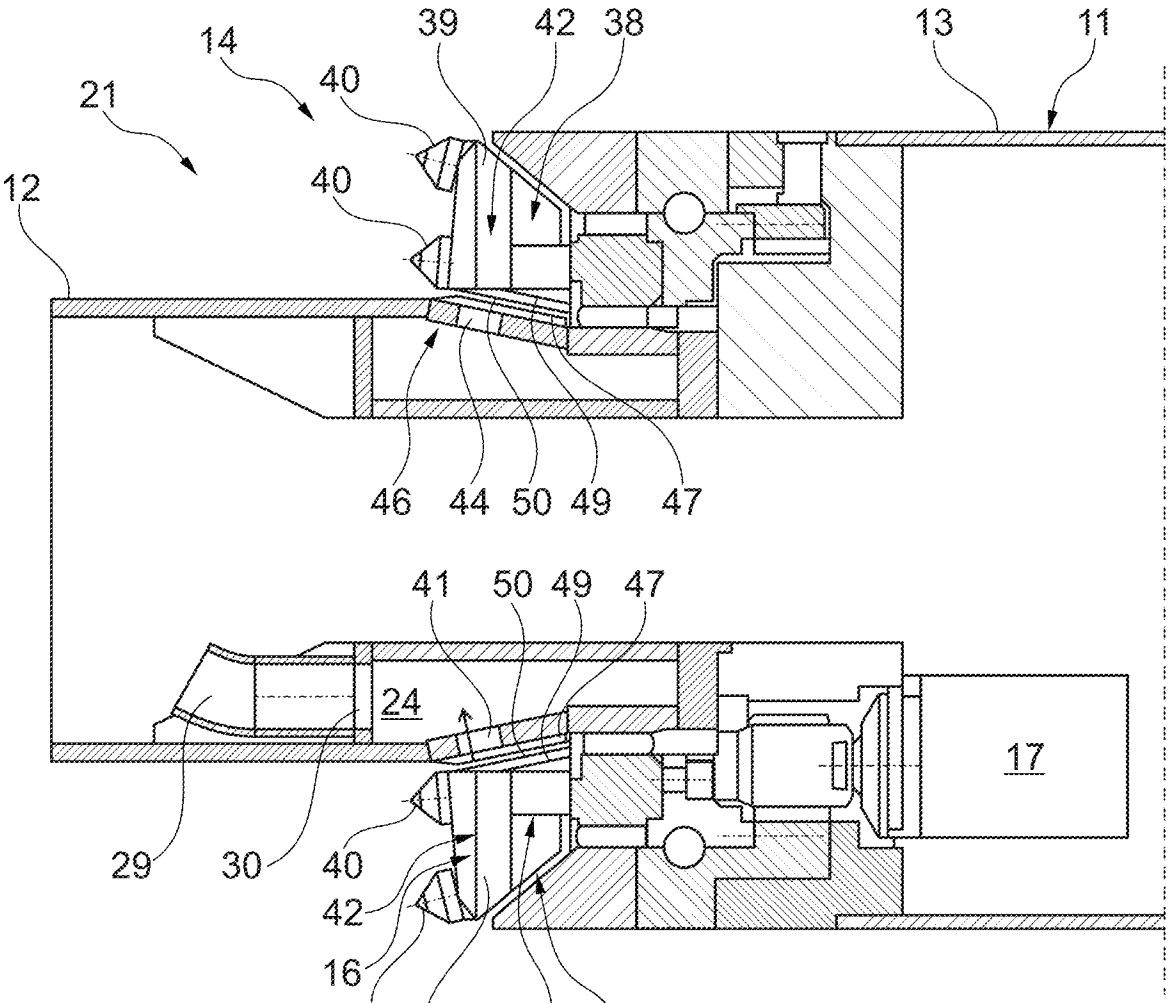
Figure 4:
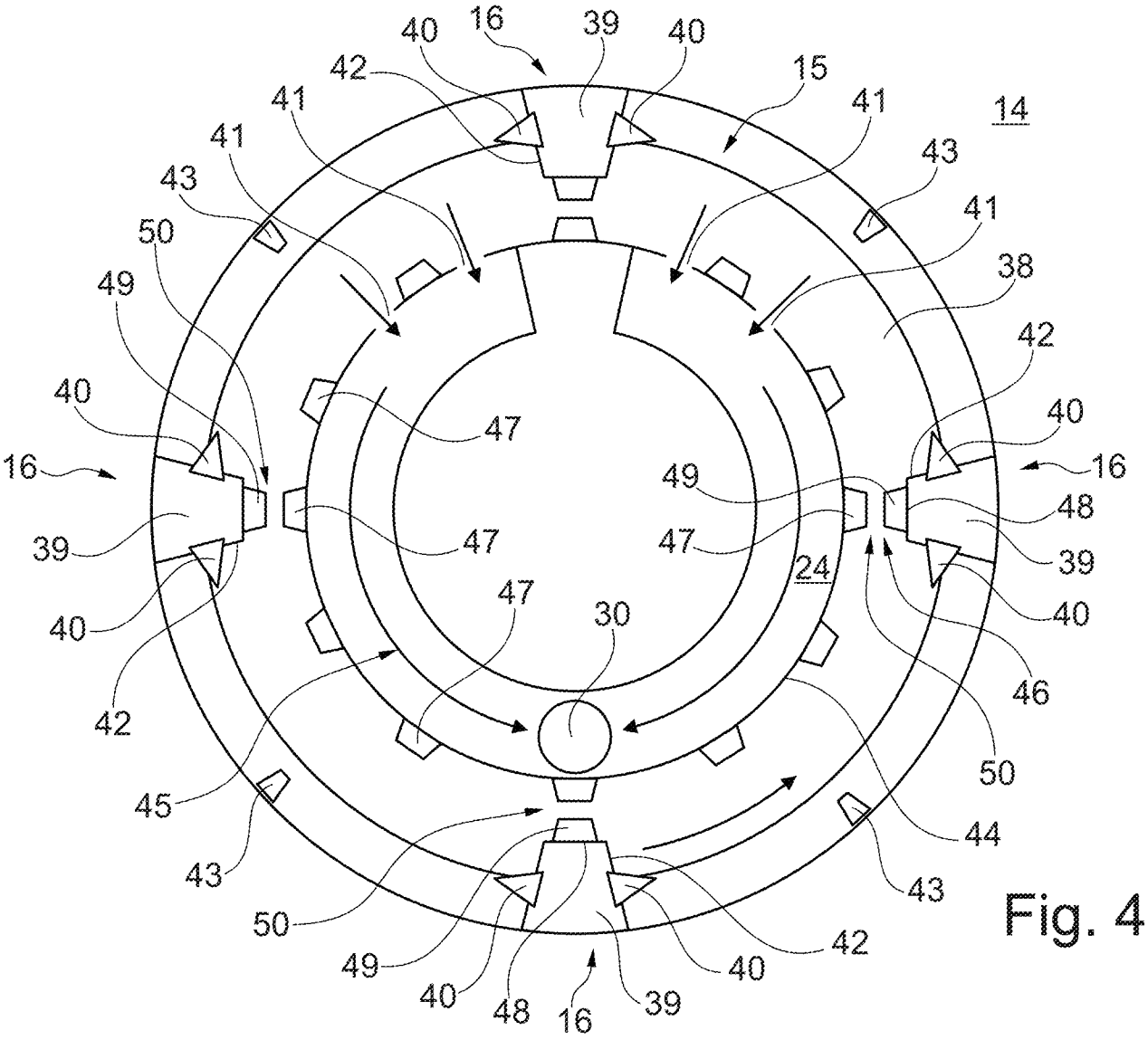
Figure 5:
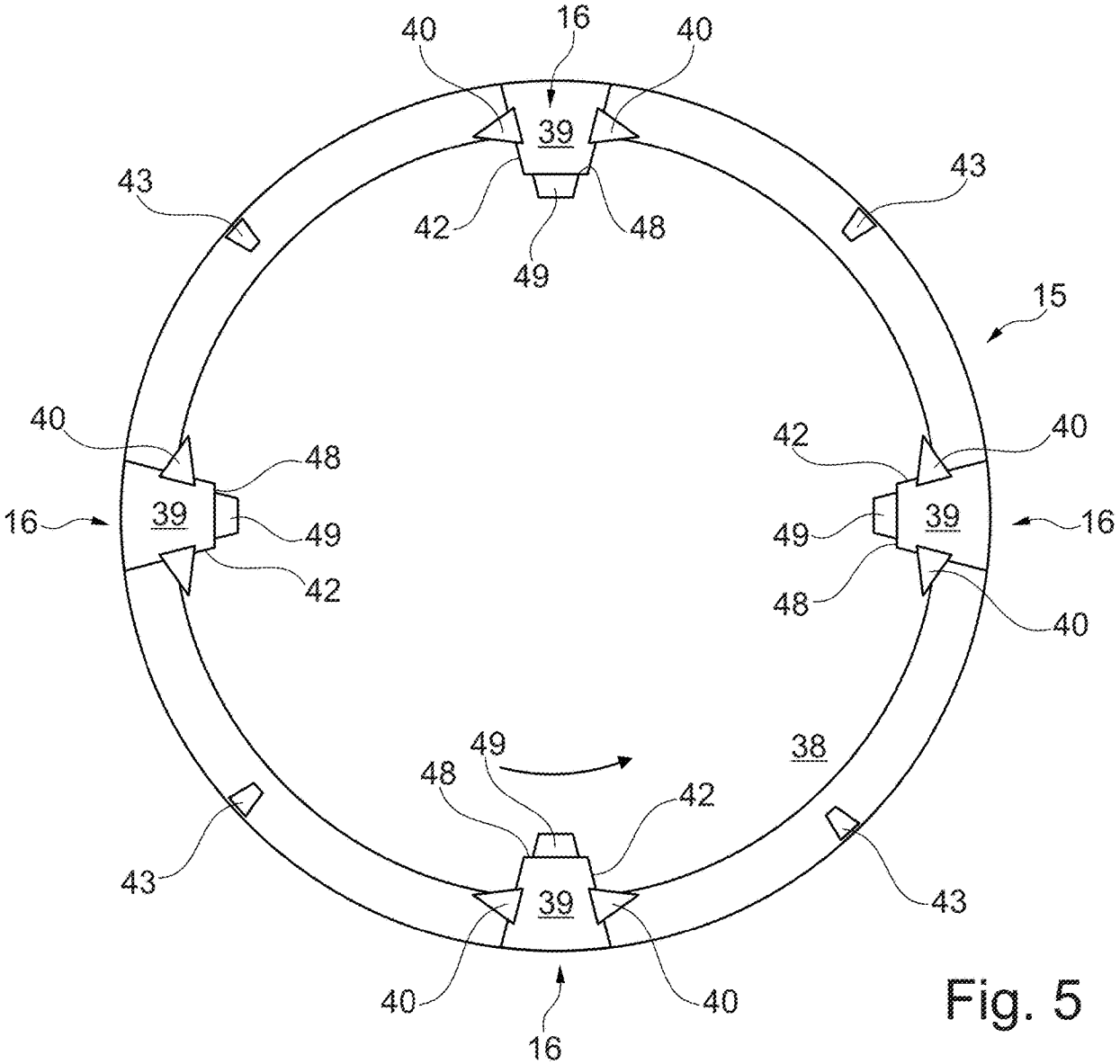
Figure 6:
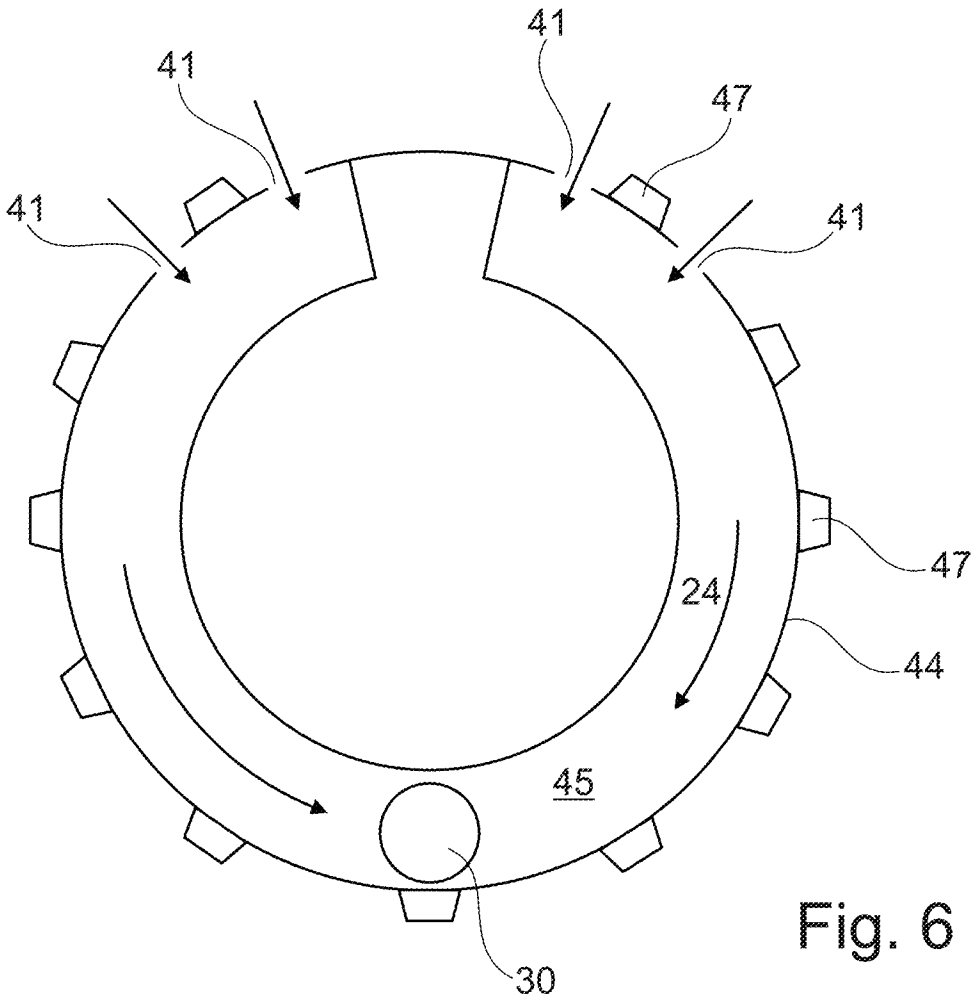

The invention is explained in more detail below using an exemplary embodiment in conjunction with a drawing. In the figures:

FIG. 1 shows a schematic diagram of a first embodiment according to the invention, FIG. 2 shows a schematic diagram of a first embodiment according to the invention, FIG. 3 shows a schematic diagram of a sectional view through an expanding drill head according to the invention, FIG. 4 shows a schematic diagram of a plan view of an expanding drill head according to the invention of FIG. 3, FIG. 5 shows a schematic diagram of a plan view of a cutting wheel according to the invention of FIG. 3, and FIG. 6 shows a schematic diagram of a plan view of a receiving chamber according to the invention of FIG. 3.

FIG. 1 shows a first embodiment of an expanding drill device 10 according to the invention. This device has a housing 11, which is divided into a front portion 12 and a rear portion 13. The front portion 13 has a first diameter, which is identical to the diameter of the pipelines in the pilot borehole (not shown).

The rear portion 13 has a second diameter, which is somewhat smaller than the diameter of a drill head 14 arranged on a drill side 21 of the housing 11.

FIG. 2 shows a second embodiment of an expanding drill device 10 according to the invention. This device has a housing 11 that has only the rear portion 13. The front portion 13 has a first diameter, which is identical to the diameter of the pipelines in the pilot borehole (not shown). In this case the rear portion 13 has a diameter that is somewhat smaller than the diameter of a drill head 14 arranged on a drill side 21 of the housing 11.

The drill head 14 has a cutting wheel, which is designed as shown in FIGS. 3 to 6, preferably as a cutting ring 15. There are drill tools 16 on the cutting ring 15, for example disk cutters, scraper blades, drill bits or the like.

The cutting ring 15 is driven using hydraulic motors 17. To drive the hydraulic motors 17, a hydraulic pump 18 is provided, which is driven for example by an electric motor 19. Also provided is a tank 20 for the hydraulic fluid with which the hydraulic pump 18 drives the hydraulic motors 17.

The drill head 14 is arranged in the drill side 21. The housing 11 also has a rear side 22, on which there is a rear stop 23 for connection to a pipeline (not shown) to be introduced into the borehole. This can be for example a swivel with tensile force measurement, preferably in the form of a hydraulic cylinder.

The cutting ring 15 is connected to a receiving chamber for receiving the loosened ground or the loosened rock, in this case preferably in the form of a suction box 24. To convey the loosened ground or the loosened rock away, a material-conveying device 25 having at least one conveying pump is provided, in this case, the material-conveying device 25 is preferably in the form of a jet pump.

The jet pump 25 can be arranged in the front portion 12 of the housing 11, as shown in FIG. 1. Alternatively, the conveying pump can also be provided in the rear portion 13 of the housing 11, as shown in FIG. 2. The jet pump 25 has a drive line 26, which is loaded by a high-pressure pump (not shown). The jet pump 25 also has a removal line 27, via which fluid supplied with the drive line 26 is conveyed away together with the mixture of fluid and loosened ground/rock extracted via a suction line 28 out of the suction box 24. The suction line 28 is connected to a suction port 29, which is connected to at least one removal opening 30 of the suction box 24.

Furthermore, a feed line 31 leads through the front portion 12 and supplies the drill head 14 with fluid to support the face and to transport away the loosened ground/rock in the region of the cutting wheel/ring 15.

Furthermore, a lubricant line 32 is provided, which leads to the rear side 22 of the housing 11. A lubricant is discharged there via an opening 33 into the annular space (not shown), to support the borehole and to reduce the friction between the outside of the pipeline (not shown) to be introduced and the borehole wall (not shown).

A front stop 34 is connected to the suction box 24, as shown in FIGS. 1 and 2. This preferably has a way of connecting it to the front portion 12. Particularly preferably, the connection between the stop 34 and the front portion 12 is such that there is an angular mobility so that the expanding drill device 10 can follow the direction of the pilot borehole better.

In FIG. 2, the stop 34 is used for connection to the pipeline in the pilot borehole. This way of connecting is preferably also designed such that there is an angular mobility here so that the expanding drill device 10 can follow the direction of the pilot borehole better.

In FIG. 1, a connecting element 36 with the pilot drill section located in the borehole is provided at the front end 35 of the front portion 12 of the housing 11.

Preferably, the connecting element 36 is identical to the connecting element of the stop 34.

The connecting elements 36 are preferably male or female connecting elements of a high-tensile plug-in sleeve connection. This has circumferential grooves in the contact faces of the male and female connecting elements, which form a spiral channel, which has at least one connecting opening to the outside for introducing a shear element, for example a chain, to produce a longitudinal force fit.

After the expanding drill device 10 is connected to the pipe section located in the pilot borehole, and the lines 26, 27, 31, 32 are connected, a valve 37 in the suction line 28 is closed, and the jet pump 25 is started up. Then the expanding drill device 10 is drawn into the ground/into the rock by retracting the pilot drill section for example with a press frame (not shown), to expand the pilot bore. The cutting ring 15 of the drill head 14 rotates in the process. The drill tools 16 loosen the ground/rock and thus expand the pilot borehole, preferably to the final size. Multiple expanding processes are likewise possible before the final pipeline is drawn in.

As soon as ground/rock is loosened, the valve 37 is opened, and the fluid-ground/rock mixture is sucked out of the suction box 24 through the removal opening 30, the suction port 29 and the suction line 28.

The cutting ring 15 is arranged in a drill chamber 38 (see FIGS. 3 to 6). The cutting ring 15 has at least one saddle 39 on which drill tools 16 are arranged. For example, scraper blades or drill bits 40 are arranged on the saddles.

The saddles 39 are in this case preferably distributed evenly around the cutting ring 15.

The saddles 39 are preferably designed such that they can carry along loosened ground/loosened rock. For example, carriers 42 are provided on the saddles 39 for this purpose.

The saddles 39/the carriers 42 transport loosened ground/loosened rock to conveying openings 41. Through these, the loosened ground/the loosened rock can pass or be sucked into the receiving chamber/the suction box 24.

The conveying openings 41 are or contain screening elements, which ensure that only conveyable grain sizes pass into the suction box 24.

Furthermore, the cutting ring 15 preferably has nozzles 43, via which feed fluid, preferably bentonite suspension, is discharged into the drill chamber 38. This is used to fill the drill chamber 387 with fluid to support the face and to allow the material transport of the loosened ground/rock in the drill chamber 38.

The receiving chamber 24 is in this case preferably designed as a hollow cylinder. The hollow cylinder has an outer wall 44, in which the conveying openings 41 are provided, preferably in the upper portion. Furthermore, the end faces 45 of the hollow cylinder are closed to provide the suction box 24.

In addition, a crusher 46 is provided in the drill chamber 38. For this purpose, crusher bars 47 are provided on the rigid outer wall 44 of the receiving chamber 24. These crusher bars are arranged fixedly in the drill chamber 38. The saddles 39 have a holding face 48, which faces the fixed crusher bars 47 and on which the crusher bars 49 are provided. There is a crusher gap 50, which defines the grain size of the material to be removed, between the fixed crusher bars 47 and the crusher bars 49 that rotate with the cutting ring 15, for example in the arrow direction A, when said bars are situated radially above one another.

The invention claimed is:

1. An expanding drill device for expanding a pilot bore created from a starting point to a target point in the ground along a specified drilling line by moving the expanding drill device along the specified drilling line in order to create a bore in the ground or in rock for introducing a pipeline or a supporting system into the expanded bore, comprising:

a housing;

a drill side and a rear side opposite the drill side;

a drill head comprising a cutting wheel on the drill side of the expanding drill device, wherein the cutting wheel is mounted and driven rotatably about a rotational axis relative to the housing; and wherein the cutting wheel comprises at least one drill tool for loosening the ground or the rock;

a drill-side connection element forming a connection to a pipe section located in the pilot bore on the drill side;

a rear-side connection for the pipeline on the rear side of the drill head;

wherein the drill side centrally has at least one receiving chamber for the loosened ground or the loosened rock, the receiving chamber being connected via at least one removal opening to a material-conveying device of the expanding drill device for the loosened ground or the loosened rock, wherein the drill side comprises at least one drill chamber containing the cutting wheel, wherein the drill chamber is arranged around the receiving chamber, wherein the cutting wheel is annular and rotates about the receiving chamber, and wherein the receiving chamber is connected via at least one conveying opening to the drill chamber whereby the loosened ground or the loosened rock can be conveyed through the conveying opening into the receiving chamber, wherein;

the drill chamber comprises at least one crusher comprising:

first crusher bars on the rotatable cutting wheel, which move together with the cutting wheel;

second crusher bars on a side of the receiving chamber facing the drill chamber, which are fixed relative to the receiving chamber, wherein a crusher gap exists between the first and second crusher bars.

2. The expanding drill device as claimed in claim 1, wherein the receiving chamber is a hollow cylinder, whose end faces are closed.

3. The expanding drill device as claimed in claim 2, wherein the at least one removal opening of the receiving chamber is on an end face of the hollow cylinder, and comprises a suction box.

4. The expanding drill device as claimed in claim 2, wherein the at least one conveying opening is on the outer lateral surface of the hollow cylinder.

5. The expanding drill device as claimed in claim 4, wherein the conveying opening is at the top of the outer lateral surface of the hollow cylinder.

6. The expanding drill device as claimed in claim 1, wherein the receiving chamber is connected fixedly to the housing.

7. The expanding drill device as claimed in claim 1, wherein the drill-side connection is connected fixedly to at least one of the housing or the receiving chamber.

8. The expanding drill device as claimed in claim 1, wherein the at least one conveying opening is one of a screening element, or comprises a screening element.

9. The expanding drill device as claimed in claim 1, wherein the material-conveying device comprises at least one conveying pump, whose suction side is connected to the removal opening.

10. The expanding drill device as claimed in claim 9, wherein the at least one conveying pump is a jet pump.

11. The expanding drill device as claimed claim 1, wherein the rear-side connection is connected fixedly one of to the housing or to the receiving chamber.

12. The expanding drill device as claimed in claim 11, wherein the rear-side connection comprises a rotatable portion, which allows a relative rotation between the housing of the expanding drill device and the pipeline.

13. The expanding drill device as claimed in claim 11, wherein the rear-side connection comprises a measuring element for measuring the drawing-in force acting on the pipeline to be introduced.

14. The expanding drill device as claimed in claim 12, wherein one of the rotatable portion or a measuring element comprises a hydraulic cylinder.

15. The expanding drill device as claimed 1, further comprising at least one discharge opening on the rear side for discharging a bentonite suspension into an annular space of the expanded bore.

* * * * *